US008274202B2

(12) United States Patent
Poe

(10) Patent No.: US 8,274,202 B2
(45) Date of Patent: Sep. 25, 2012

(54) SPARK PLUG WITH RECEIVING END OF GROUND ELBOW SET ABOVE DISCHARGE TERMINAL OF CENTRAL ELECTRODE AND LOCATED BY ONE SIDE OF CENTRAL ELECTRODE EXTENSION LINE

(75) Inventor: Jen-Chun Poe, Taipei (TW)

(73) Assignee: Top 1 Green Development Co., Ltd., Taipei (TW)

( * ) Notice: Subject to any disclaimer, the term of this patent is extended or adjusted under 35 U.S.C. 154(b) by 16 days.

(21) Appl. No.: 12/899,519

(22) Filed: Oct. 6, 2010

(65) Prior Publication Data

US 2011/0115361 A1 May 19, 2011

(30) Foreign Application Priority Data

Nov. 16, 2009 (TW) ..... 98221229 U

(51) Int. Cl.
*H01T 13/20* (2006.01)

(52) U.S. Cl. ..... 313/141; 313/118; 313/140; 313/142

(58) Field of Classification Search ..... None
See application file for complete search history.

(56) References Cited

U.S. PATENT DOCUMENTS

2007/0252503 A1* 11/2007 Rossi ..... 313/141

* cited by examiner

*Primary Examiner* — Natalie Walford
(74) *Attorney, Agent, or Firm* — Leong C. Lei

(57) ABSTRACT

A spark plug include an insulator, a central electrode, which is in the form of a bar received in the insulator, a metal case, which surrounds the insulator and is grounded, and a ground elbow fixed to the metal case. The central electrode includes a discharge terminal exposed outside the insulator and defining an extension line as an imaginary line extending from the discharge terminal along a central axis of the central electrode. The ground elbow has a connection end and an opposite, sharp-tip-like receiving end. The connection end is fixed to the metal case. The receiving end is set close to but spaced from the discharge terminal and is locate by one side of the extension line.

8 Claims, 4 Drawing Sheets

SPARK PLUG WITH RECEIVING END OF GROUND ELBOW SET ABOVE DISCHARGE TERMINAL OF CENTRAL ELECTRODE AND LOCATED BY ONE SIDE OF CENTRAL ELECTRODE EXTENSION LINE

TECHNICAL FIELD OF THE INVENTION

The present invention generally relates to a spark plug, and more particularly to a spark plug for use in the operation of vehicle engine.

DESCRIPTION OF THE PRIOR ART

The operation of an engine is realized by successively supplying high voltage pulses to electrodes of spark plugs, making the plugs repeatedly discharging electricity for ignition of an air-fuel mixture contained inside a cylinder for generating explosion to provide energy for power output of the engine.

Referring to FIG. 1, a conventional spark plug 9 is constructed so that a slender central electrode 91 is received through a ceramic insulator 92. An outer circumference of the insulator 92 is tightly wrapped by a ground metal case 93. The metal case 93 forms an external thread 931, so that the spark plug 9 can be securely mounted to a cylinder head of an engine with the external thread 931. The metal case 93 has a top to which a ground elbow 932 (or multiple ground elbows) is welded. When the metal conductor 91 receives a high-voltage electric pulse, a spark is generated and travels between a discharge terminal 911 of the central electrode 91 and the ground elbow 932 to thereby ignite a fuel-air mixture contained inside the cylinder.

The minimum distance between the discharge terminal 911 of the central electrode 91 and the ground elbow 932 is often referred to as a spark plug gap. Proper setting of the spark plug gap is vital to the performance of the spark plug. This, however, is often overlooked by general people. When the gap is not properly set (namely being of different spacing) and thus results in approximately 2% miss of sparking of the spark plug, although a driver is not likely to percept abnormality of the vehicle, yet the exhaust gas of the vehicle contains about double the amount of hydrocarbons, which leads to air pollution and also causes a waste of fuel.

To install a spark plug 9, the ground elbow 932 is set facing downward. Further, during the operation of an engine, the spark plug 9 is in a high temperature condition. Thus, for long term operation, the gravity of the portion of the ground elbow 932 that is located under the discharge terminal 911 gradually increases the height $L_1$ of the ground elbow 932, making it stretched to a 90-degree bend. Further, the gravity and the material softening due to being heated lead to a gradual expansion of the spark plug gap to around 100-130 degrees. When the expansion reaches a predetermined level, electric discharge no longer occurs in the spark plug 9, leading to failure or miss of sparking.

SUMMARY OF THE INVENTION

Thus, an objective of the present invention is to provide a spark plug that reduces sparking failure rate.

To achieve the above objective, according to the present invention, a spark plug comprises an insulator, a central electrode, which is in the form of a bar received in the insulator, a metal case, which surrounds the insulator and is grounded, and a ground elbow fixed to the metal case. The central electrode comprises a discharge terminal exposed outside the insulator and defining an extension line as an imaginary line extending from the discharge terminal along a central axis of the central electrode. The ground elbow has a connection end and an opposite, sharp-tip-like receiving end. The connection end is fixed to the metal case. The receiving end is set close to but spaced from the discharge terminal and is locate by one side of the extension line.

Preferably, the receiving end of the present invention set above the centrally-located discharge terminal in a partly overlapping fashion, or is set by an outer circumference of the discharge terminal.

The efficacy of the present invention is that the edge of the sparking terminal of the ground elbow is set close to the discharge terminal of the central electrode, so that, based on the point discharge principle, by making the discharge terminal and the electricity receiving terminal both in sharp tip like configuration, the spark plug according to the present invention can easily generate sparking between the discharge terminal and the sparking terminal and thereby lower the sparking failure rate and the chance of malfunctioning.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
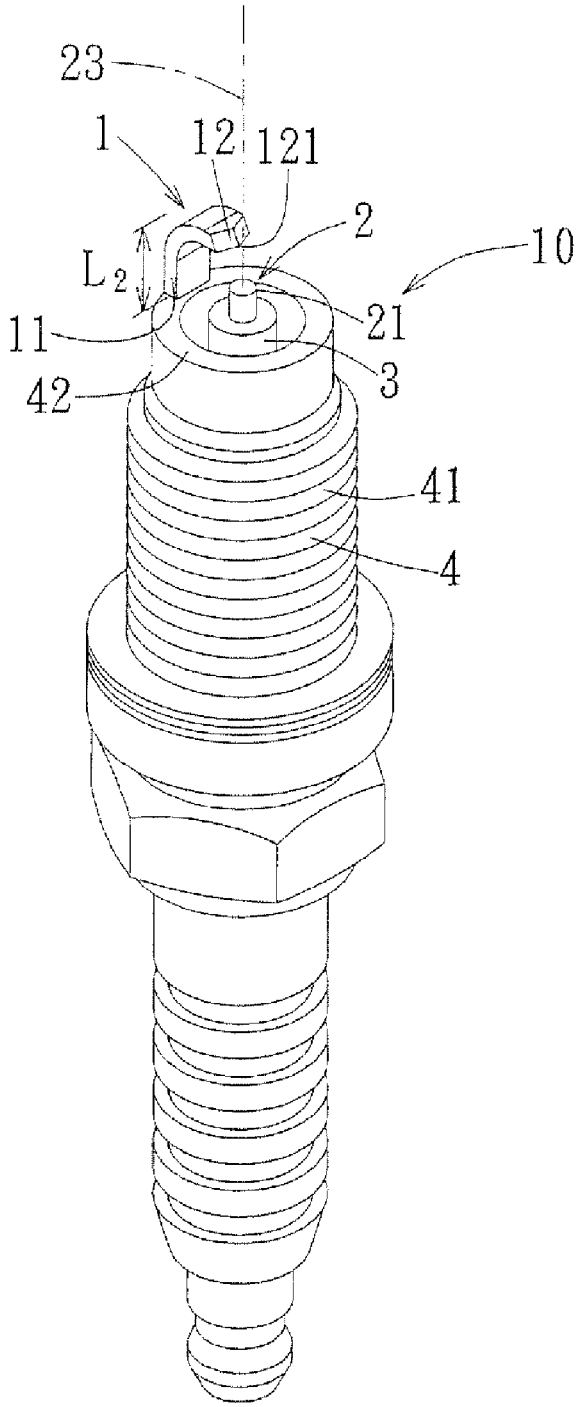
FIG. 2 is a perspective view showing a spark plug according to a preferred embodiment of the present invention.

Referring to FIG. 2, a spark plug constructed in accordance with a first embodiment of the present invention, generally designate at 10, comprises a tubular ceramic insulator 3, a bar-like central electrode 2 received in the insulator 3, a metal case 4 surrounding the insulator 3 and grounded, and a ground elbow 1 fixed to the metal case 4, preferably by welding.

The central electrode 2 comprises a discharge terminal 21 exposed outside the insulator 3, whereby when a vehicle engine is started or is in operation, a distributor (not shown) of the vehicle supplies a high voltage to the central electrode 2 to generate sparks and thus driving the operation of the engine. To simplify the description that will be given, an extension line 23 is first defined as an imaginary line extending from the discharge terminal 21 along a central axis of the central electrode 2.

In the instant embodiment, the metal case 4 that surrounds the insulator 3 has an outer circumference forming an external thread 41, which allows the spark plug 10 to be threadingly fixed to a cylinder head (not shown) of the vehicle engine and forming a grounding connection with the vehicle body.

Figure 3:
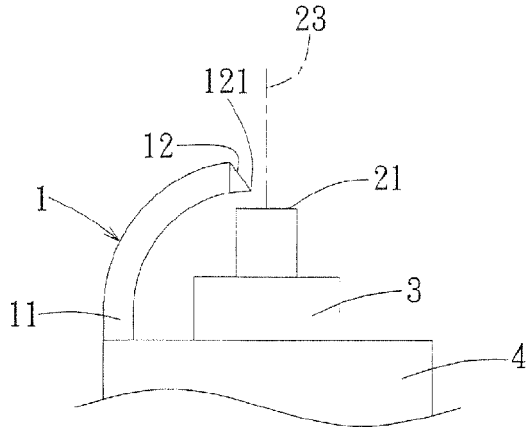
FIG. 3 is a partly side elevational view of the spark plug according to the present invention, showing the position and shape of a receiving end of a ground elbow.

Referring to FIGS. 2 and 3, in the instant embodiment, the ground elbow 1 is of an L-shape (or a J-shape), comprising a connection end 11 and an opposite, sharp-tip-like receiving end 12. The connection end 11 is fixed to an end face 42 of the metal case 4 that is adjacent to the discharge terminal 21 of the central electrode 2. The receiving end 12 is set above, in a partly overlapping but spaced fashion, the discharge terminal 21, and the receiving end 12 is located by one side of the extension line 23. In other words, as compared to the conventional spark plug 9 shown in FIG., where the extension line 94 intersects and extends through the ground elbow 932, the extension line 23 according to the instant embodiment of the present invention does not intersect and extend through the receiving end 12 of the ground elbow 1, and is instead located in front of the receiving end 12.

Figure 1:
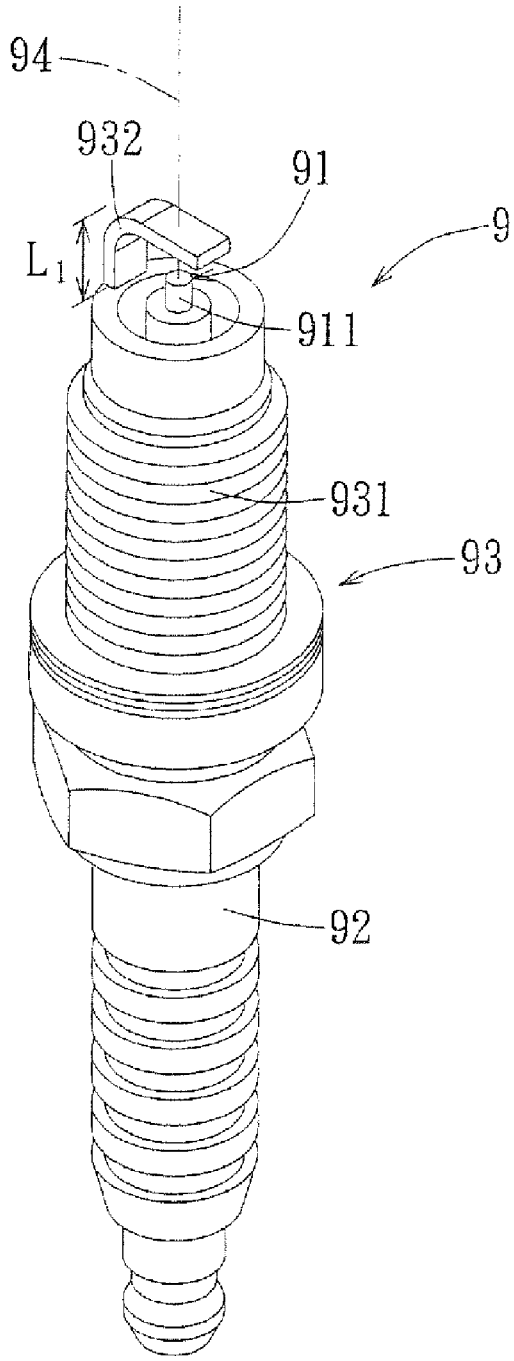
FIG.1 PRIOR ART
FIG. 1 is a perspective view showing a conventional spark plug.

The regular way of installing a spark plug 10 is to make the ground elbow 1 facing downward. This, together with the high temperature induced in the operation of the engine, will gradually increase the height $L_2$ of the ground elbow 1. However, a comparison between the conventional ground elbow 932 shown in FIG. 1 and the ground elbow 2 according to the instant embodiment of the present invention shown in FIG. 2 clearly shows that the length of the portion of the conventional ground elbow 932 that is located above the discharge terminal 911 is much greater than that of the portion of the ground elbow 1 according to the instant embodiment of the present invention that is located above the discharge terminal 911. Thus, with width, thickness, and material being identical, the conventional ground elbow 932 is of a greater weight than the ground elbow 1 according to the present invention. Consequently, the increase of the height $L_1$ of the conventional ground elbow 932 will be of a greater rate than that of the increase of the height $L_2$ of the ground elbow 1 according to the present invention, making the expansion of gap of the conventional spark plug faster than the spark plug of the present invention. In other words, the spark plug 10 according to the instant embodiment of the present invention has a longer period of time of normal operation and thus a longer lifespan than the conventional ones.

It is noted that in the instant embodiment, the receiving end 12 is formed as a sharp tip configuration, comprising a sharp tip 121 located close to the discharge terminal 21. When a high voltage is supplied to the central electrode 2, the receiving end 12 induces and accumulates a large number of electrical charges. Since the sharp tip 121 has a surface curvature that is greater than other portions, the sharp tip 121 of the receiving end 12 can collect denser electrical charges, making it much easier for the discharge terminal 21 to discharge electrical current to the sharp tip 121 and thus generates sparking. An electrical charge carrying object showing denser electrical charges at a portion of greater surface curvature is appreciated through the discussion of point discharge principle. This is well known to those having ordinary skills and no detailed discussion is needed herein.

Figure 4:
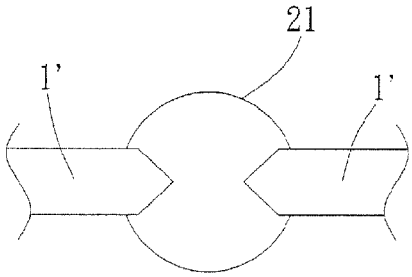
FIG. 4 is a schematic top plan view of a spark plug according to the present invention, showing an alternate configuration of the spark plug containing two ground elbows that have receiving ends partly overlapping but spaced from a discharge terminal.
Figure 5:
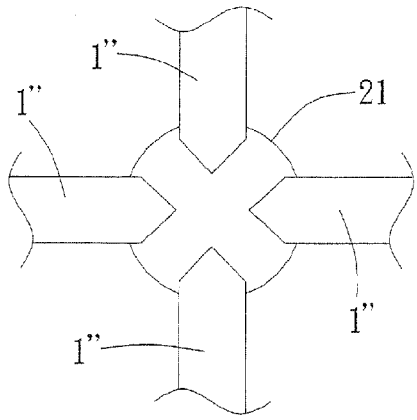
FIG. 5 is a schematic top plan view of a spark plug according to the present invention, showing another alternate configuration of the spark plug containing four ground elbows that have receiving ends partly overlapping but spaced from a discharge terminal.
Figure 6:
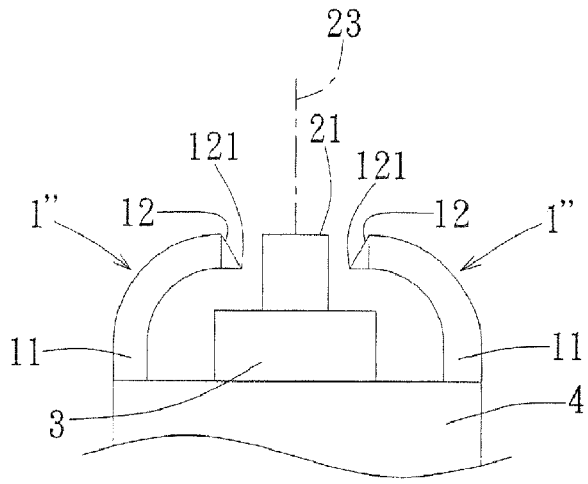
FIG. 6 is a partly side elevational view of a spark plug according to the present invention, showing the positions and shapes of receiving ends of ground elbows, in which the receiving ends are located on opposite sides of the discharge terminal.
Figure 7:
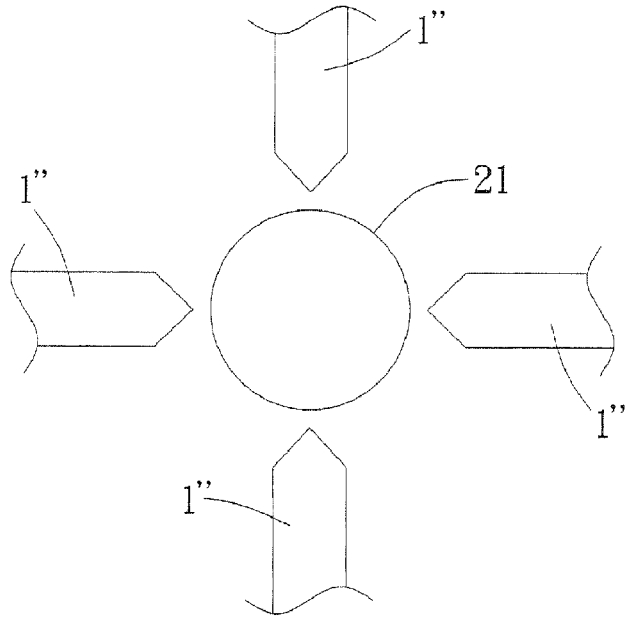
FIG. 7 is a schematic top plan view of a spark plug according to the present invention, showing a further alternate configuration of the spark plug containing four ground elbows that have receiving ends located by an outer circumference of a discharge terminal.

Referring to FIGS. 4 and 5, in the instant embodiment, the number of the ground elbow 1 included in the spark plug is one. However, it is also feasible to increase the number of ground elbow for a spark plug to form a dual-ground or multi-ground configuration of spark plug. FIG. 4 is a schematic view illustrating a dual-ground spark plug configuration comprising two ground elbows 1' and FIG. 5 is a schematic view illustrating a multi-ground spark plug configuration comprising four ground elbows 1". Further, the receiving end 12 may also be arranged to face an outer circumference of the discharge terminal 21, as shown in FIG. 6, wherein a dual-ground spark plug comprising two ground elbows 1" and the receiving ends 12 of the two ground elbows 1" are located at equal distance from the discharge terminal 21 is shown. FIG. 7 schematically illustrates a multi-ground spark plug that has four ground elbows 1" having receiving ends 12 located at equal distance from an outer circumference of the discharge terminal 21.

In summary, according to the point discharge principle, by placing the sharp tip 121 of the receiving end 12 of the ground elbow 1 (1', 1") close to the discharge terminal 21 of the central electrode 2, the spark plug 10 according to the present invention can more easily generate sparking between the discharge terminal 21 and the receiving end 12 and thus the sparking failure rate is reduced, leading to an increases of outputs of horsepower and torque, lowering of the amount of hydrocarbons contained in exhaust gas, and reduction of fuel consumption. Further, since the receiving end 12 of the ground elbow 1 is shorter and sharper than the conventional ones, the expansion or elongation rate is smaller than the conventional spark plug. As a result, the period of time of normal operation for the spark plug 10 is made longer, and the spark plug 10 can generate sparking for engine operation with only a voltage level of 8000-10000 volts so that the lifespan is extended as compared to the conventional spark plugs.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A spark plug, comprising:

an insulator;

a central electrode, which is in the form of a bar received in the insulator and comprising an end face located outside the insulator for forming a discharge terminal, an extension line being defined as a line extending from the end face of the central electrode along a central axis of the central electrode;

a metal case, which surrounds the insulator and is grounded; and at least one ground elbow, which has a connection end and an opposite, sharp-tip-like receiving end, the connection end being fixed to the metal case, the receiving end being set close to but spaced from the end face of the central electrode, wherein the receiving end of the ground elbow is set above the end face of the central electrode in a partly overlapping fashion and located by one side of the extension line.

2. The spark plug according to claim 1, wherein the ground elbow is of an L-shape, and the connection end of the ground elbow is fixed to an end face of the metal case that is adjacent to the end face of the central electrode.

3. The spark plug according to claim 1, wherein the receiving end of the ground elbow forms a sharp tip located close to and spaced from the end face of the central electrode.

4. The spark plug according to claim 2, wherein the receiving end of the ground elbow forms a sharp tip located close to and spaced from the end face of the central electrode.

5. The spark plug according to claim 1, further comprising a plurality of ground elbows, each of which comprises a connection end and an opposite, sharp-tip-like receiving end, the connection end being fixed to the metal case, the receiving end being set close to but spaced from the end face of the central electrode and being set above the end face of the central electrode in a partly overlapping fashion and located by one side of the extension line.

6. The spark plug according to claim 5, wherein each of the ground elbows is of an L-shape or a J-shape, the connection end of each of the ground elbows being fixed to an end face of the metal case that is adjacent to the end face of the central electrode.

7. The spark plug according to claim 5, wherein the receiving end of each of the ground elbows forms a sharp tip located close to and spaced from the end face of the central electrode.

8. The spark plug according to claim 6, wherein the receiving end of each of the ground elbows forms a sharp tip located close to and spaced from the end face of the central electrode.

* * * * *